US005490808A

United States Patent [19]

Jantschek et al.

[11] Patent Number: 5,490,808

[45] Date of Patent: Feb. 13, 1996

[54] ABRASIVE ATTACHMENT SYSTEM FOR ROTATIVE ABRADING APPLICATIONS

[75] Inventors: Robert J. Jantschek, Stillwater, Minn.; Forrest J. Rouser, San Rafael, Calif.; Mark L. Sterner, Mahtomedi; Theodore J. Testen, St. Paul, both of Minn.

[73] Assignee: Minnesota Mining and Manufacturing Company, St. Paul, Minn.

[21] Appl. No.: 380,239

[22] Filed: Jan. 30, 1995

Related U.S. Application Data

[63] Continuation of Ser. No. 10,680, Jan. 28, 1993, abandoned.

[51] Int. Cl.[6] ..... B24B 5/42

[52] U.S. Cl. ..... 451/59; 451/168

[58] Field of Search ..... 451/173, 168, 451/538, 539, 526, 59

[56] References Cited

U.S. PATENT DOCUMENTS

| | | | |
|---|---|---|---|
| 983,093 | 1/1911 | Svenson . | |
| 2,206,223 | 7/1940 | Dearborn | 287/130 |
| 2,461,201 | 2/1949 | Ellis | 2/311 |
| 2,499,898 | 3/1950 | Anderson | 24/206 |
| 2,558,367 | 6/1951 | Madsen | 24/201 |
| 2,632,894 | 3/1953 | Louis | 2/320 |
| 2,717,437 | 9/1955 | Mestral | 28/72 |
| 2,780,261 | 2/1957 | Svec et al. | 150/3 |
| 2,991,596 | 7/1961 | Walters | 51/197 |
| 3,039,340 | 8/1962 | Livermont | 81/177 |
| 3,054,434 | 9/1962 | Ausnit et al. | 150/3 |
| 3,101,517 | 8/1963 | Fox et al. | 24/204 |
| 3,173,184 | 3/1965 | Ausnit | 24/201 |
| 3,192,589 | 7/1965 | Pearson | 24/204 |
| 3,263,292 | 8/1966 | Fekete | 24/206 |
| 3,266,113 | 8/1966 | Flanagan, Jr. | 24/204 |
| 3,408,705 | 11/1968 | Kayser et al. | 24/204 |
| 3,604,145 | 9/1971 | Zimmerman | 46/25 |
| 3,899,805 | 8/1975 | McMillan | 24/213 |
| 3,955,245 | 5/1976 | Ballin | 24/201 |
| 4,123,826 | 11/1978 | Tanaka | 24/204 |
| 4,263,755 | 4/1981 | Globus | 51/406 |
| 4,437,269 | 3/1984 | Shaw | 51/358 |
| 4,581,792 | 4/1986 | Spier | 24/575 |
| 4,665,557 | 5/1987 | Kamp | 383/63 |
| 4,682,444 | 7/1987 | Judge et al. | 51/154 |
| 4,710,968 | 12/1987 | Borchardt et al. | 383/63 |
| 4,794,674 | 1/1989 | Mintel et al. | 24/143 |
| 4,819,309 | 4/1989 | Behymer | 24/576 |

(List continued on next page.)

FOREIGN PATENT DOCUMENTS

| | | | |
|---|---|---|---|
| 0349653 | 1/1990 | European Pat. Off. | B24B 21/16 |
| 2564158 | 11/1985 | France | F16B 5/07 |
| 1101823 | 4/1955 | Germany . | |
| 1807993 | 7/1970 | Germany | F16B 5/06 |
| 0276082 | 5/1975 | Germany | F16S 3/04 |
| 3840019 | 5/1990 | Germany | B24D 9/08 |
| 2039810 | 8/1980 | United Kingdom | B24D 17/00 |

OTHER PUBLICATIONS

Brochure entitled "Coated Abrasives—Modern Tool of Industry", (1965), pp. 109–110.

Brochure entitled "3M Imperial™ Microfinishing Film"; by 3M of St. Paul, Minnesota; No. 60–4400–2443–2(71.2)JR; 1991; 2 pages.

Article entitled "Microfinishing Abrasive Film Meets Tighter Finishing Specifications"; Manufacturing Engineering, May, 1983, p. 65.

*Primary Examiner*—Robert A. Rose

*Attorney, Agent, or Firm*—Gary L. Griswold; Walter N. Kirn; James J. Trussell

[57] ABSTRACT

The present invention relates to a method and apparatus for abrading a workpiece. The apparatus includes an abrasive tape having a microstructured surface on the back face thereof, and a support shoe having a microstructured surface on an exposed pressure face. The two microstructured surfaces intermesh and resist displacement of the abrasive tape with respect to the pressure face as the workpiece is rotatively abraded.

12 Claims, 6 Drawing Sheets

U.S. PATENT DOCUMENTS

| | | | |
|---|---|---|---|
| 4,875,259 | 10/1989 | Appeldorn | 24/576 |
| 4,993,191 | 2/1991 | Judge et al. | 51/154 |
| 5,088,164 | 2/1992 | Wilson et al. | 24/576 |
| 5,097,570 | 3/1992 | Gershenson | 24/452 |
| 5,109,638 | 5/1992 | Kime, Jr. | 51/406 |
| 5,113,555 | 5/1992 | Wilson et al. | 24/576 |
| 5,201,101 | 4/1993 | Rouser et al. | 24/575 |

ABRASIVE ATTACHMENT SYSTEM FOR ROTATIVE ABRADING APPLICATIONS

This is a continuation of application Ser. No. 08/010,680 filed Jan. 28, 1993, now abandoned.

TECHNICAL FIELD

This invention relates to abrasives, and specifically to a method and apparatus for preventing relative displacement between an abrasive tape and a support shoe during rotational abrasive contact between the abrasive tape and an outer peripheral surface of a workpiece.

BACKGROUND OF THE INVENTION

Abrasives are used in a variety of settings to produce a desired surface finish on a workpiece. Within the field of microfinishing, abrasives are used to abrade specified amounts of material from a workpiece to provide a surface finish that meets certain parameters. In the automotive field, for example, journals such as camshafts and crankshafts for internal combustion engines must meet exacting standards for geometry and surface finish. If a camshaft or a crankshaft is improperly sized or finished, uneven wear patterns may result, and could lead to failure of that component or other components within the engine.

The present invention relates primarily to abrading an outer peripheral surface of a workpiece, such as the bearing surfaces of the journal, shown as a camshaft in FIG. 1. One manner of microfinishing such a surface is to provide a support shoe having a pressure face against which an abrasive sheet or tape is placed, contact the abrasive face of the tape to the peripheral surface, and rotate the workpiece with respect to the support shoe. The abrasive tape may be, for example, a coated abrasive, a lapping abrasive, or a nonwoven abrasive. Preferred abrasive products for these applications are fine grade abrasive grains that range in average particle size from less than 0.1 up to 200 micrometers, preferably between about 5 to 125 micrometers. The support shoe can be made out of any material that is sufficiently durable to withstand the rigors of the abrading process. Common materials for the pressure face include but are not limited to urethanes, India stone materials, metals or hard coatings on metals. The pressure face may be unitary, or may include multiple pressure face segments that combine to form a profile that matches that of an outer peripheral surface of a workpiece.

FIGS. 1 and 2 illustrate an apparatus 10 for abrading material from the individual peripheral surfaces of a workpiece 12. The support shoes 14 and 16 include pressure faces 18 and 20 that are typically concave, and match the desired profile of the peripheral surface of the workpiece 12 being abraded. In the illustrated embodiment, two semicylindrical pressure faces 18 and 20 large abrasive tape 22 against surface 24 of workpiece 12. When workpiece 12 is rotated, abrasive tape 22 abrades material from the outer peripheral surface of workpiece 12, due to pressure from pressure faces 18 and 20 against the surface. Pressure faces 18 and 20 may also be moved transversely across the peripheral surface of workpiece 12 as the workpiece is rotated, as shown by directional arrows 15. Transverse motion of the pressure faces produces a multidirectional scratch pattern on the surface of the workpiece, which may be desirable for certain applications. In the case of microfinishing a camshaft or a crankshaft (i.e. abrading minute amounts of material from a surface), more than one peripheral surface may be abraded simultaneously. Camshaft and crankshaft microfinishing is described in U.S. Pat. Nos. 4,682,444 (Judge et al.) and 4,993,191 (Judge et al.).

For some applications, lubricants such as mineral seal oil are provided at the abrasive interface between the surface of the workpiece and the abrasive tape to carry abraded particles away from the abrasive interface, and to enable increased heat transfer away from the workpiece. These lubricants are preferably water soluble to facilitate cleaning of the work area. However, because the abrasive tape is subjected to a rotary shear force during abrading, and to a shear force if the workpiece is moved transversely (as shown by directional arrow 15 in FIG. 1), the lubricant tends to facilitate slippage between the abrasive tape and the pressure face. It is important to maintain the abrasive tape in position with respect to the pressure face, and thus slippage is undesirable because the abrasive tape may become displaced with respect to the pressure face.

Moreover, given a sufficient amount of displacement, the abrasive tape may not be properly located over the pressure face, causing uncontrolled scratches in the surface of the workpiece and potentially dislodging or tearing the abrasive tape. Furthermore, because the abrading process may be automated, a dislocation of or break in the tape may damage not only the workpiece currently being abraded, but several or even dozens of successive workpieces before the disruption is discovered. If the abrasive tape has been broken, it may wrap around the workpiece, which may in turn cause the manufacturing line to shut down, which is time consuming and undesirable. If the abrasive tape breaks, the entire production line may have to be halted, so that the abrasive tape may be threaded through the abrading apparatus again, which is a costly and therefore undesirable procedure.

One manner of reducing slippage of the abrasive tape with respect to the pressure face beneath the tape is to apply a slip resistant coating to the back face of the abrasive tape.. For example, Minnesota Mining and Manufacturing Company of St. Paul, Minn. sells a 262L or 272L Imperial Microfinishing film product Type S, and a 263L or 273L Imperial Microfinishing film product Type Q. Each film includes a slip resistant coating disposed on the back face of the film, comprising an inorganic particulate dispersed in a polymeric binder. The slip resistant coating tends to reduce slippage between the abrasive tape and the pressure face, resulting in more satisfactory abrading processes than those described above.

Although slip resistant coatings may alleviate some slippage of the abrasive tape, other problems may render the use of slip resistant coatings undesirable. For example, it is possible for the slip resistant coating such as an adhesive to transfer to and subsequently build up on the support shoe, which may cause the abrasive tape to abrade unevenly. Even small deposits of a slip resistant coating can raise the effective height of the support shoe, and can result in excessive abrading of the workpiece. In an automated environment, the accumulation of small amounts of slip resistant coating over a period of time may therefore result in workpieces being microfinished to different sizes. This may represent a sacrifice of consistency and accuracy in microfinishing in exchange for the slip resistant properties of the coating, which is unacceptable.

It is therefore desirable to provide a method and apparatus for releasably positioning an abrasive tape on a support shoe for abrading a workpiece, and to reduce slippage between the abrasive tape and the support shoe during abrading, without using slip resistant coatings.

Abrasive sheets and tapes have a certain useful life, after which they begin to degrade, causing irregular microfinishing of the workpiece. It is therefore desirable to advance the abrasive tape periodically, to provide a new abrasive surface for application to the workpiece. Advancing the abrasive tape is known in the art as "indexing" the abrasive tape, and the tape is typically indexed between ⅛" and 8", and more typically between ½" and 1" after a particular surface has been finished. Thus, it is therefore desirable to provide a method and apparatus for abrading a workpiece, wherein the abrasive tape may be indexed periodically.

SUMMARY OF THE INVENTION

The present invention includes an apparatus for abrading an outer peripheral surface of a workpiece. The apparatus includes an abrasive tape having an abrasive face and an opposed back face including a first microstructured surface, support means having a pressure face for supporting the abrasive tape thereon, the pressure face including a second microstructured surface for intermeshing engagement with the first microstructured surface, the support means for urging the abrasive tape against the workpiece, and means for rotating one of the workpiece and the support means relative to the other of the workpiece and the support means. The abrasive face abrades material from the peripheral surface of the workpiece during relative rotation between the workpiece and the support means.

Also provided is a support shoe for use in supporting an abrasive tape against a workpiece as one of the support shoe and the workpiece is rotated relative to the other. The support shoe has a pressure face for supporting the abrasive tape thereon, the pressure face including a microstructured surface for intermeshing engagement with a cooperative microstructured surface on a back surface of an abrasive tape to secure the abrasive tape to the pressure face.

In another aspect of the present invention, an apparatus is provided for abrading an outer peripheral surface of a journal. The apparatus includes an abrasive tape having an abrasive face and a back face including a first microstructured surface, and at least one support shoe having a pressure face for supporting the abrasive tape thereon, the pressure face including a second microstructured surface adapted for intermeshing engagement with the first microstructured surface, the at least one shoe adapted to urge the abrasive tape against the peripheral surface of the journal. The abrasive face abrades material from the peripheral surface when the journal is rotated relative to the support means.

Another aspect of the invention regards an abrasive tape for use in abrading a surface of a workpiece. The abrasive tape includes an abrasive face and a back face including a microstructured surface adapted for engagement with an opposed microstructured surface to resist displacement of the tape with respect to the opposed surface.

In yet another aspect of the invention, a method of abrading an outer peripheral surface of a workpiece is provided, including the steps of providing an abrasive tape having an abrasive face and a back face including a first microstructured surface; providing a support shoe having a pressure face for supporting the abrasive tape thereon, the pressure face including a second microstructured surface adapted for intermeshing engagement with the first microstructured surface; intermeshing the first and second microstructured surfaces such that the abrasive tape is supported on the pressure face; contacting the outer peripheral surface of workpiece with the abrasive tape; and inducing relative rotation between the workpiece and the support shoe to abrade material from the peripheral surface of the workpiece.

BRIEF DESCRIPTION OF THE DRAWINGS

The invention will be more readily understood with reference to the accompanying drawings, wherein like reference numerals refer to like components throughout the several views, and wherein.

DETAILED DESCRIPTION OF THE INVENTION

The present invention relates to a method and apparatus for abrading a workpiece, such as a journal. In brief, the apparatus includes an abrasive tape having a microstructured surface on the back face thereof, and a support shoe having a microstructured surface on an exposed pressure face that supports the abrasive tape. The two microstructured surfaces intermesh and prevent relative displacement of the abrasive tape as the workpiece is rotatively abraded. Although the workpiece is typically rotated with respect to a stationary support shoe, the workpiece could be held stationary and the support shoe rotated, or the two components could be rotated in opposite directions simultaneously. Thus the present invention should be understood to have utility in rotative abrading generally. Furthermore, although the abrasive is referred to herein as a "tape," that term is not intended to limit the relative size or construction of the abrasive member used in conjunction with the present invention. The present invention is thought to have particular applicability to abrading journals (i.e. a machine shaft that is supported at each end by a bearing) such as camshafts and crankshafts, although other uses are contemplated.

Figure 1:
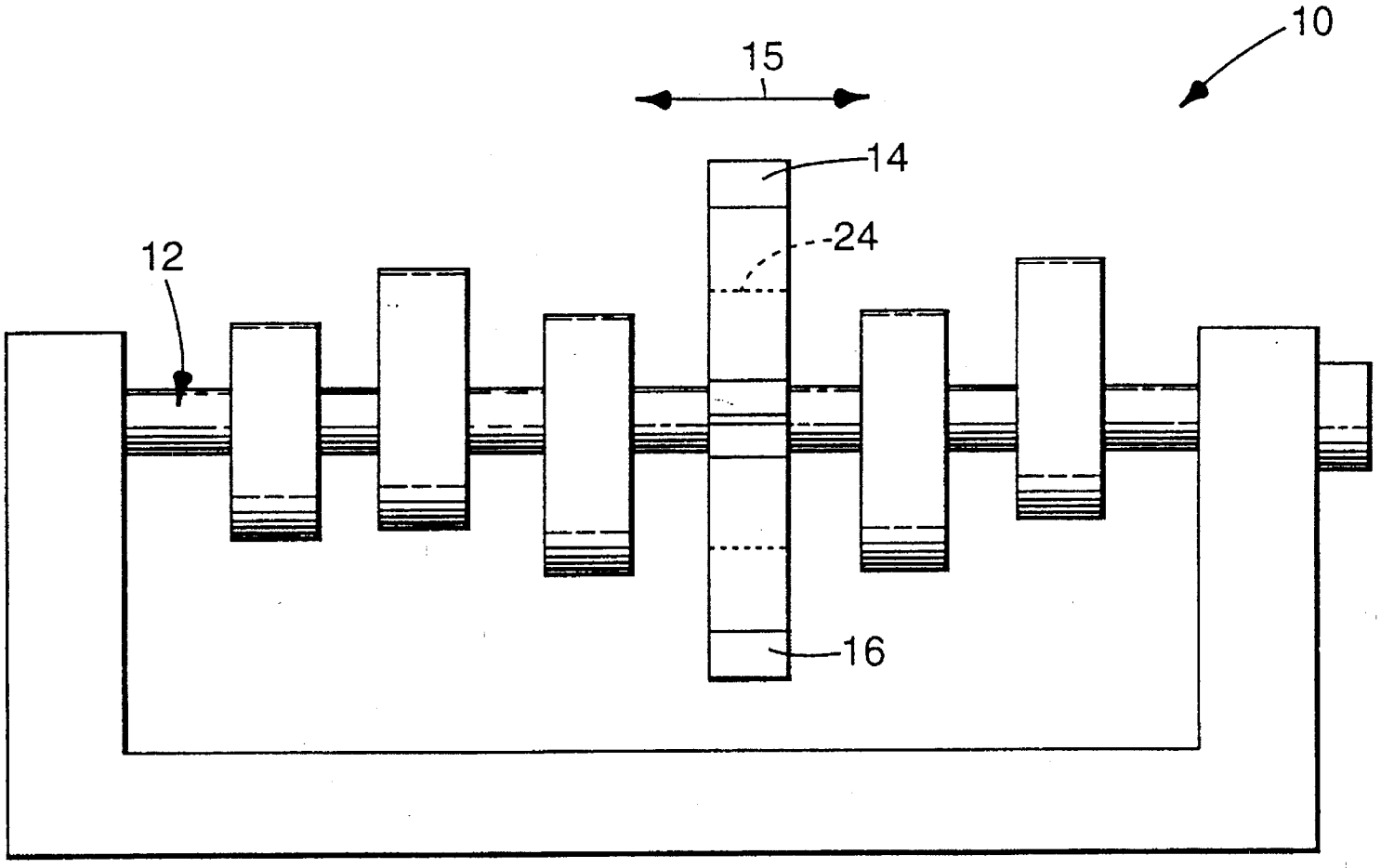
FIG. 1 is a side view of an apparatus for abrading a workpiece.
Figure 2:
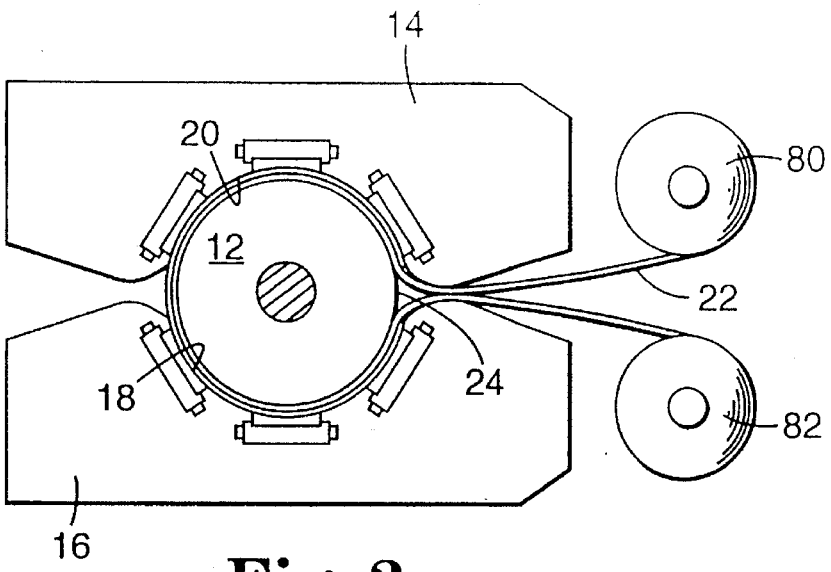
FIG. 2 is a cross sectional view of a support shoe, abrasive tape, and a workpiece.
Figure 3:
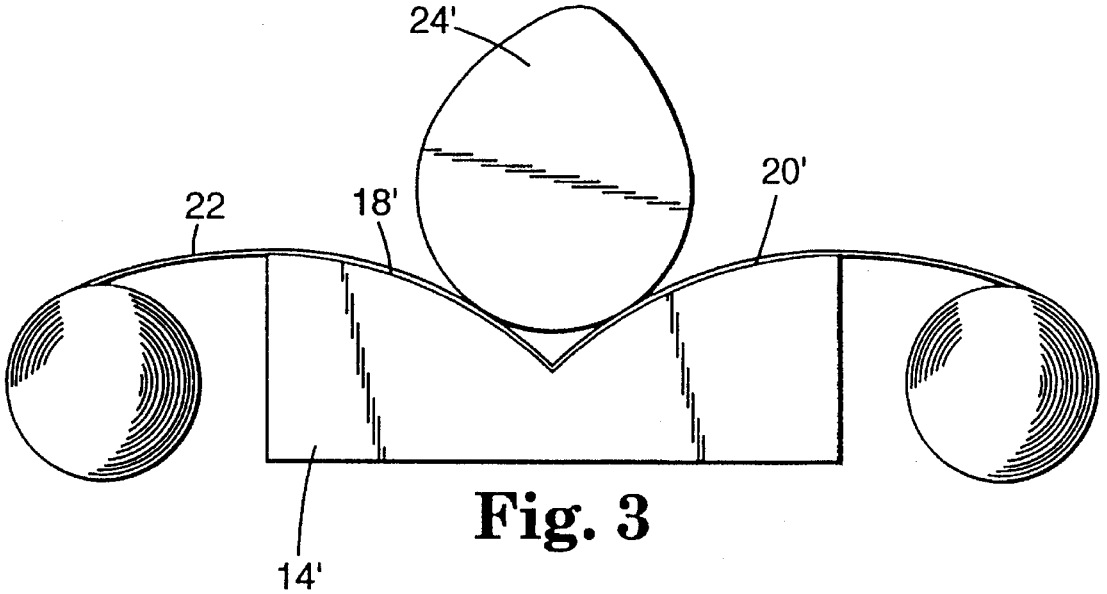
FIG. 3 is an alternate embodiment of a support shoe.

Support means are provided, and are depicted in the embodiment illustrated in FIGS. 1 and 2 as support shoes 14 and 16. Support shoes 14 and 16 include pressure faces 18 and 20, respectively, which conform to the surface of the workpiece to be abraded. For example, in FIG. 2 a cylindrical portion 24 of a workpiece is adapted for rotation with respect to support shoes 14 and 16 that include semicylindrical pressure faces 18 and 20. In other embodiments, support shoe 14' may include one or more convex pressure faces 18' and 20' that are adapted to present an abrasive tape 22 for contact with a cam-shaped portion 24', as shown in FIG. 3 Other support shoe and pressure face configurations are also contemplated, and may be selected as known in the art.

Figure 4:
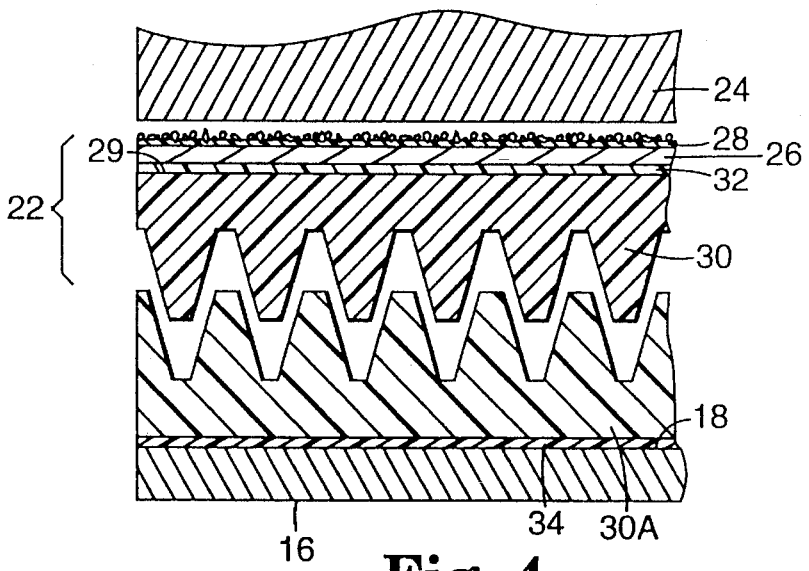
FIG. 4 is cross sectional view of the interface between the support shoe and the abrasive tape in accordance with the present invention.

As shown in FIG. 4, the present invention generally provides an abrasive tape 22 including a substrate 26 having an abrasive coating or finish on an abrasive face 28, and a microstructured surface 30 on a back face 29. A "microstructured surface," as that term is used with respect to the present invention, is a surface having a plurality of arranged tapered structures raised above that surface, which structures are adapted for intermeshing engagement with an opposed microstructured surface. Such tapered structures are shown and described further herein, and may include truncated pyramids, cones, parallel alternating ridges and grooves, and the like. The respective microstructured surfaces may be similar or dissimilar, as discussed further below, but must be susceptible of mutual intermeshing engagement.

The microstructured surfaces are preferably selected such that the surfaces remain intermeshed when subjected to a relatively high shear force, but disengage when subjected to a relatively low peel force. Thus during abrading, when a rotating workpiece may apply a high shear force, the abrasive tape remains firmly secured to the support shoe, and does not slip with respect to the support shoe. However, when it is necessary to index the abrasive tape, the microstructured surfaces may be separated by peeling the abrasive tape away from the support shoe.

The microstructured surface can be made of metal or plastic, such as thermoplastic materials (e.g. polyvinyl chloride), thermosetting materials, and radiation cured polymers. It is preferred that the microstructured surfaces be relatively thin, so that the pattern of the microstructured surface does not significantly impact on the surface finish of the workpiece during abrading. For example, a microstructured surface including a plurality of arranged tapered structures having height of approximately 0.0635 cm (0.025 in), as described in the Examples below, has been shown to have utility.

Figure 5:
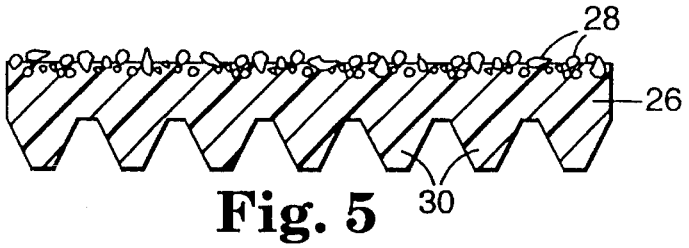
FIG. 5 is a cross sectional view of an abrasive tape having a microstructured back face.

Microstructured surface 30 may be bonded to abrasive tape 22, such as by a bonding layer 32, or may be integrally formed in abrasive tape 22 as shown in FIG. 5, whereby the adhesive layer could be eliminated. An opposed microstructured surface 30A is either attached to pressure face 18 of support shoe 16 by a bonding layer 34, or is integrally formed in pressure face 18, and is adapted to intermesh with microstructured surface 30. When the microstructured surfaces 30 and 30A are intermeshed, abrasive tape 22 is positioned and retained with respect to support shoe 16 during abrading.

Figure 6:
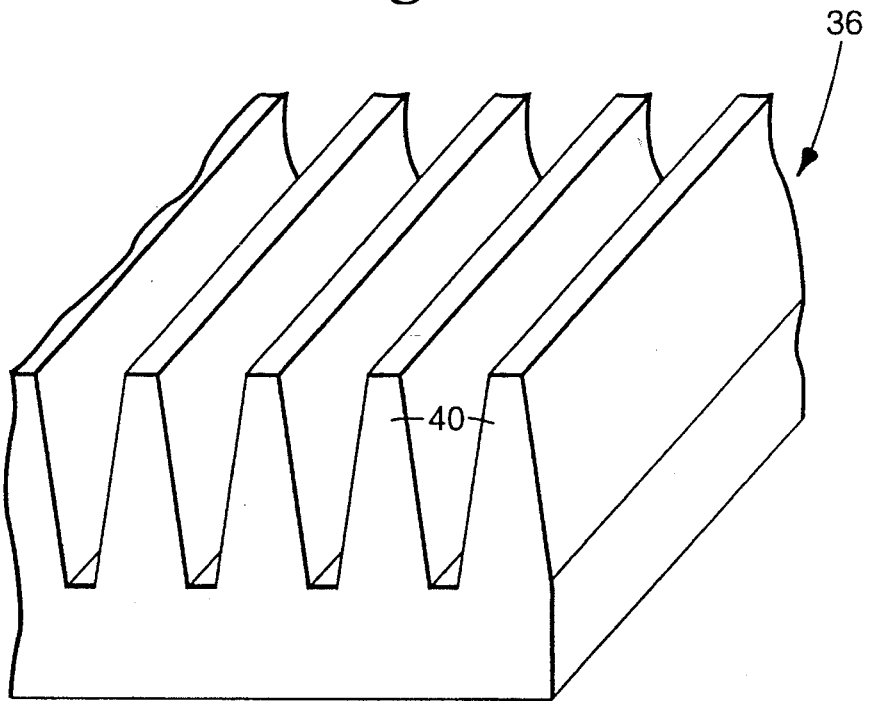
FIG. 6 is a perspective view of a microstructured surface for use in the context of the present invention.
Figure 7A:
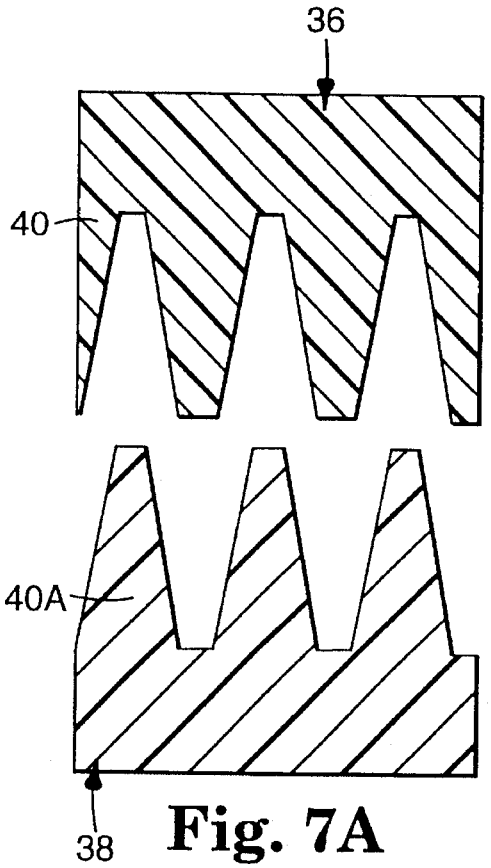
FIGS. 7A, 7B, and 7C are sequential illustrations of the intermeshing engagement of opposed microstructured surfaces.
Figure 7B:
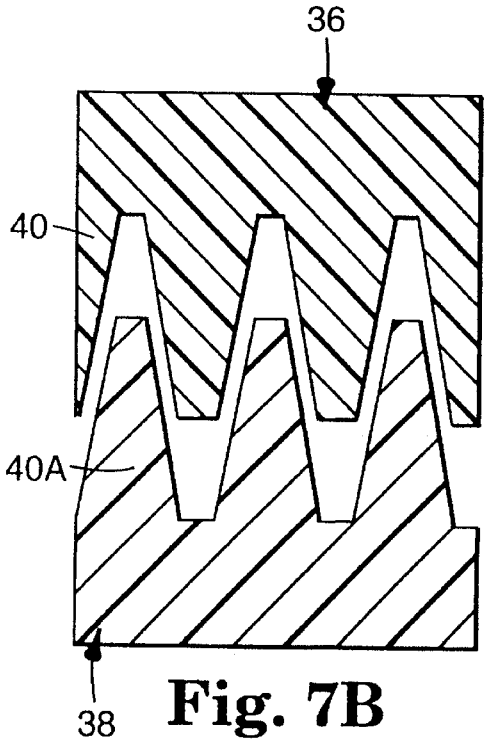
Figure 7C:
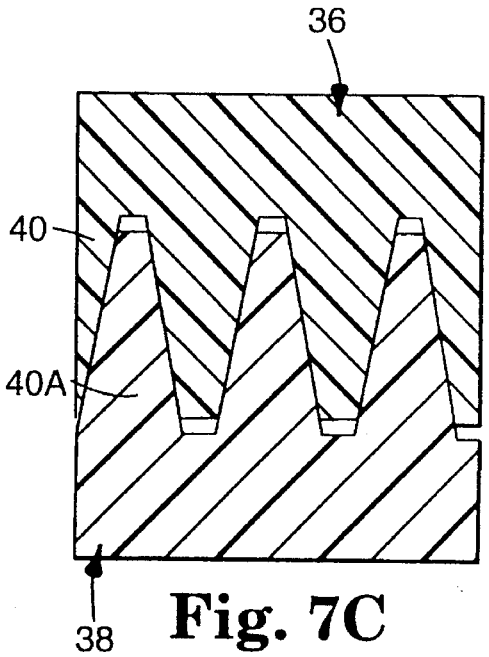

An exemplary microstructured surface topography includes a series of parallel alternating ridges and grooves, as illustrated in FIG. 6. This structure is described in U.S. Pat. No. 4,875,259 (Appledorn), which is commonly assigned to the assignee of the present invention, the contents of which are incorporated by reference herein. The structure includes a plurality of tapered elements 40 of microstructured surface 36 that are adapted to mate with opposed tapered elements 40A of microstructured surface 38, as shown in FIGS. 7A, 7B, and 7C. The sides of each element are inclined relative to the plane of the microstructured surface at an angle sufficient to form a taper such that each element will mesh with at least one corresponding element of another similar article. When the elements are meshed, frictional and torsional forces between adjacent elements tend to cause those elements to remain joined together, at least partially because of the frictional force of adherence of the contacting sides, particularly in response to shear forces. It is an advantage of this topography that the tapered elements may be aligned along the length of the abrasive tape, or across the width of the abrasive tape, or at any other desired orientation while providing resistance to slippage due to shear forces. Because the forces produced by the microfinishing process described above tend to be in shear, rather than in peel, microstructures such as those disclosed in the '259 patent are well suited for the present environment.

Figure 8:
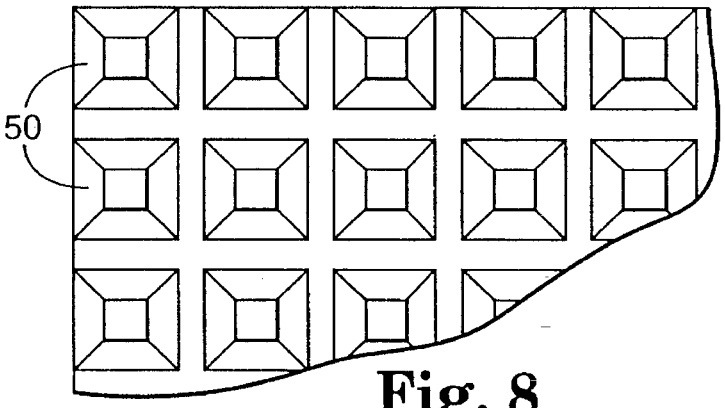
FIGS. 8 and 9 are plan views of alternate topographical configurations for a microstructured surface.
Figure 9:
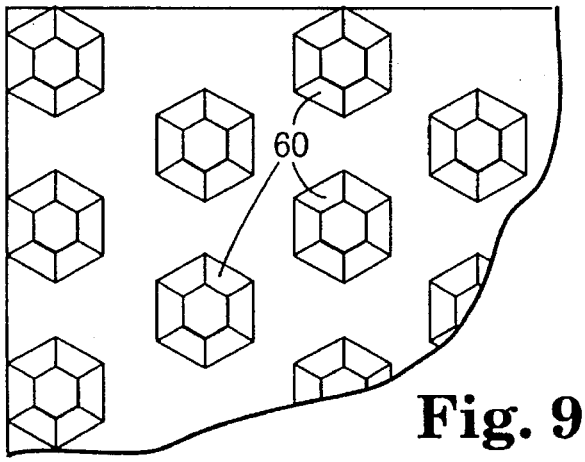

An second exemplary microstructured surface is illustrated in FIG. 8 and is disclosed in U.S. Pat. No. 4,875,259 discussed above. This topography generally includes a plurality of arranged truncated pyramids 50, which intermesh with a plurality of opposed, like pyramids to fasten the microstructured surfaces together. A microstructured surface having the parallel alternating ridge and groove topography discussed above may also be intermeshed with an appropriate truncated pyramidal microstructured surface, if desired, and many other variations can be constructed. FIG. 9 illustrates a further embodiment, wherein arranged hexagonal structures 60 are adapted to intermesh with opposed heptagonal structures to fasten the opposed microstructured surfaces together.

Figure 10:
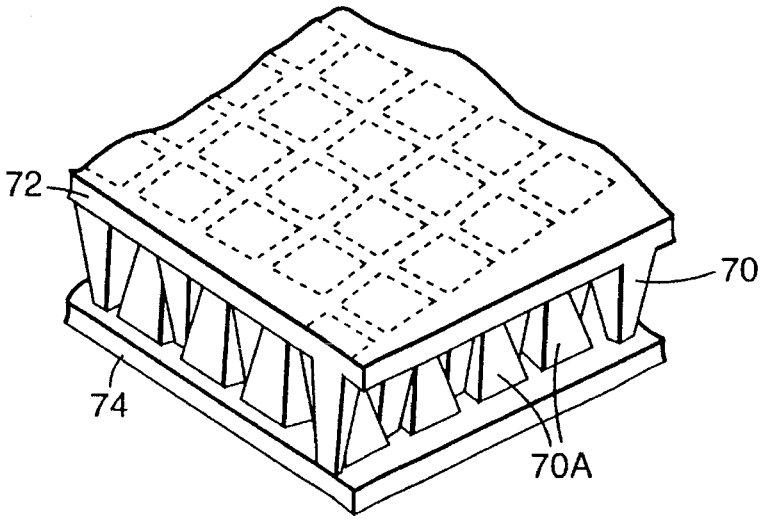
FIGS. 10 and 11 are perspective views of alternate topographical configurations for a microstructured surface.

Another exemplary microstructured surface is shown in FIG. 10. A plurality of arranged, tapered structures 70 and 70A project from the microstructured surfaces 72 and 74, and are adapted for intermeshing engagement to fasten the microstructured surfaces together. In contrast to the microstructured surfaces described previously, the structures of one surface are intentionally misaligned with respect to the structures of the other surface, which may provide some benefits such as increased resistance to disengagement due to the application of shear forces. This design is further described in U.S. patent application Ser. No. 875,186, U.S. Pat. No. 5,201,101 (Rouser et al.), which is commonly assigned to the assignee of the present invention, and the contents of which are incorporated herein by reference. In this embodiment, at least one of the microstructured surfaces is constructed from a deformable polymeric material. These structures have the added advantage that they need not be perfectly aligned to enable intermeshing engagement, which permits rapid engagement of the microstructured surfaces.

Figure 11:
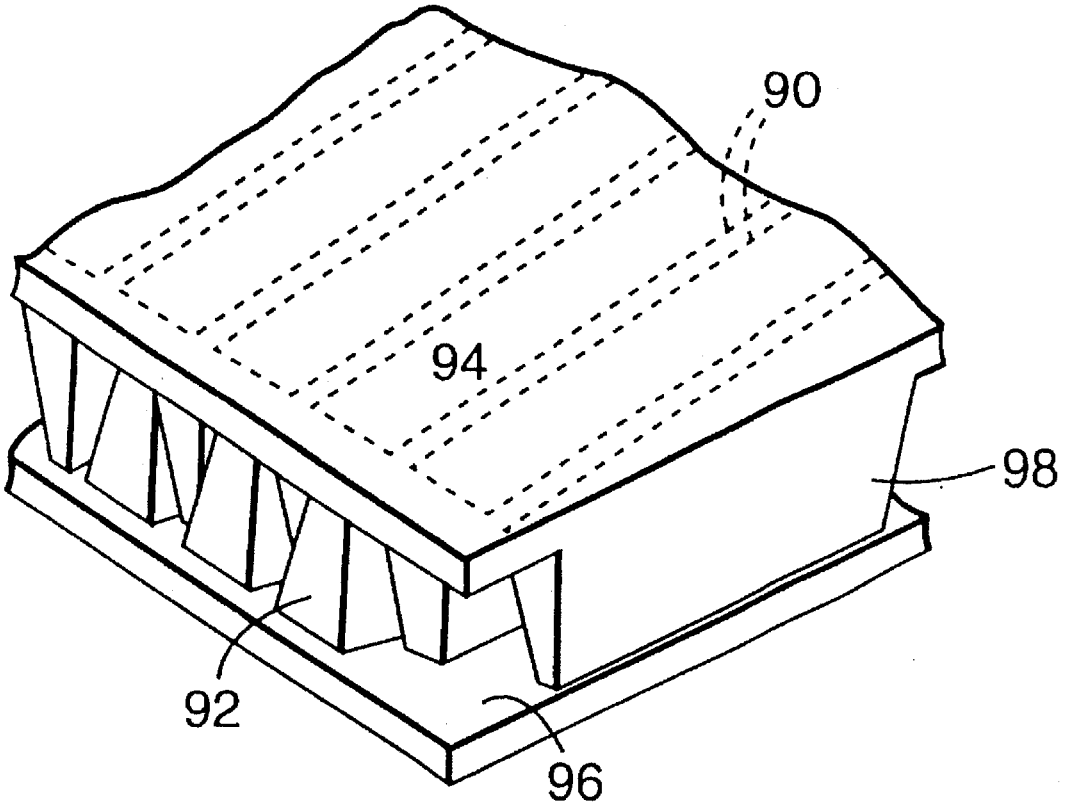

FIG. 11 illustrates another embodiment of intermeshed microstructures that may have utility in the context of the present invention. First microstructured surface 90 comprises an aligned plurality of parallel alternating ridges 92 and grooves 94. Second microstructured surface 96 comprises an arranged plurality of projecting truncated pyramids 98 such as those shown at 70A in FIG. 10. The embodiment of FIG. 11 is similar to that shown in FIG. 10, in that the first and second microstructured surfaces are typically misaligned with respect to each other prior to intermeshing engagement, and in that at least one of the surfaces should be constructed of a resilient polymeric material.

The microstructured surfaces discussed herein are intended to be illustrative rather than limiting, and the present invention should be understood to have applicability in conjunction with any suitable microstructured surface now known or later developed.

The present invention will be better understood with reference to several examples, wherein the test procedure was as follows. A slip test was performed by placing an abrasive tape with its back side against the pressure face of a support shoe of the type generally used for crankshaft finishing. The width of the support shoe was approximately 3 cm (1.2 in), and the abrasive tape measured approximately 1.9 cm (0.75 in) wide and 18 cm (7.1 in) long. A metal plate was placed in contact with the exposed abrasive surface of the abrasive tape, and a compressive force of approximately 10.3 kg (27.9 lbs) was applied to the support shoe in the direction of the metal plate. The support shoe was held in place, and the metal plate was allowed to move along with the abrasive tape.

A tensile testing machine Model No. 1123, available from the Instron Corporation of Canton, Mass., applied a tensile force to two jaws that were attached to one end of the abrasive tape. A tensile force was applied to the abrasive tape in a direction parallel to the surface of the support shoe at a rate of $2.2\times10^{-4}$ m/s ($6.9\times10^{-4}$ ft/s, or 0.5 in/min). During testing, the force on the abrasive tape gradually increased until the tape slipped with reference to the support shoe. The peak force value, which is recorded in the following table, occurred immediately prior to slippage of the tape. Tests using this methodology were conducted using no lubrication (column one) and using lubrication (column two). In the latter case, the abrasive tape and support shoe were flooded with mineral seal oil prior to testing.

THE EXAMPLES

The Comparative Example represents tests conducted with an abrasive tape that did not comprise a microstructured surface according to the present invention, but did include a slip resistant coating on the back face of the abrasive tape. The support shoe for the Comparative Example included a stone insert having a continuous surface against which an abrasive tape was pressed by the metal plate. The area of the shoe with which the abrasive tape was in contact measured approximately 1.9 cm×1.9 cm (0.75 in×0.75 in), or 3.63 $cm^2$ (0.56 $in^2$).

Examples One, Two, and Three represent tests conducted with abrasive tape having three different microstructured surface configurations according to the present invention. All of the microstructured surfaces were made by compression molding polyvinyl chloride with a master tool. The microstructured surfaces were laminated to a metal shoe by a pressure sensitive adhesive commercially available from Minnesota Mining and Manufacturing Company under the trade designation 3M 468 Hi Performance pressure sensitive adhesive tape. Although a stone pressure face was used for the Comparative Example, and a metal pressure face was used for Examples One, Two, and Three, the difference in performance between the two types of pressure faces is believed to be negligible. Except as noted above, the testing parameters remained substantially the same during each test sequence.

Comparative Example

In the Comparative Example, the abrasive tape was a 5 mil 3M 272L Type S IMPERIAL Brand aluminum oxide microfinishing film having a 30 micrometer abrasive surface, which is commercially available from Minnesota Mining and Manufacturing Company of St. Paul, Minn. The abrasive tape included a slip resistant coating comprising calcium carbonate on the back face of the tape.

Example One

A microstructured surface similar to that shown in FIG. 8 was attached to the back side of the abrasive tape used in the comparative example, and a like microstructured surface was attached to the support shoe by the pressure sensitive adhesive described above. The microstructured surfaces each included a plurality of arranged tapered structures having height of approximately 0.0635 cm (0.025 in).

Example Two

In this Example, the microstructured surface attached to the back side of the abrasive tape was the parallel alternating ridge and groove topography illustrated in FIG. 6. The ridges were aligned with the longitudinal, or down-web direction of the abrasive tape, and had a height of approximately 0.0635 cm (0.025 in).

The microstructured surface attached to the shoe was a four-sided truncated pyramid pattern as illustrated in FIG. 8, and was laminated to the metal shoe by the pressure sensitive adhesive described above. The truncated pyramids had a height of approximately 0.0635 cm (0.025 in).

Example Three

In this Example, a microstructured surface having parallel alternating ridges and grooves of the type illustrated in FIG. 6 was applied to the abrasive tape. The ridges of the microstructured surface extended in the transverse, or cross-web direction, and had a height of approximately 0.0635 cm (0.025 in).

A microstructured surface having a truncated pyramid pattern as illustrated in FIG. 8 was attached to the support shoe. The microstructured surface was adhered to the shoe by the pressure sensitive adhesive described above, and included a plurality of arranged tapered structures having height of approximately 0.0064 cm (0.0025 in).

RESULTS

The results of the Comparative Example and Examples One, Two, and Three are tabulated below. The number in parentheses represent the percentage improvement between the Example result and the Comparative Example result.

| | Pressure Required (Dry) | Pressure Required (Lubricated) |
|---|---|---|
| Comparative Example | 1.75 $kg/cm^2$ | 2.18 $kg/cm^2$ |
| Example One | 3.34 $kg/cm^2$ (191%) | 4.49 $kg/cm^2$ (206%) |
| Example Two | 4.61 $kg/cm^2$ (263%) | 3.18 $kg/cm^2$ (146%) |
| Example Three | 4.99 $kg/cm^2$ (285%) | 1.66 $kg/cm^2$ (76%) |

Higher force values indicate that the abrasive tape was more resistant to slippage with respect to the support shoe. The tabulated data therefore illustrates that the present invention tends to resist relative displacement between the abrasive tape and the support shoe to a greater degree than abrasive tapes having a slip resistant back face. The tests and test results described above are intended solely to be illustrative, rather than predictive, and variations in the testing procedure can be expected to yield different results.

The present invention also contemplates indexing the abrasive tape periodically to provide a new abrasive surface for application to the workpiece. In use, support shoes 14 and 16 urge abrasive tape 22 against the workpiece for a given period of time, and then the support shoes separate from the workpiece. The two microstructured surfaces are released from one another by indexing means 80 and 82 shown schematically in FIG. 2, and then at least one of either the abrasive tape or the support means is indexed relative to the other. That is, a predetermined length of abrasive tape is withdrawn from the area where the abrasive contacts the workpiece, which thereby draws an equal length of new abrasive tape into the area for contact with the workpiece. An advantage of the present invention is that a relatively low peel force causes the abrasive tape to separate from the support shoe, enabling facile indexing of the abrasive tape. When the abrasive tape has been advanced sufficiently, the support shoes close around the workpiece, and cause the two microstructured surfaces to mesh together to retain the abrasive tape with respect to the pressure face. The abrading process may then begin again.

The present invention has now been described with reference to several embodiments thereof. It will be apparent to those skilled in the art that many changes can be made in the embodiments described without departing from the scope of the invention. For instance, although the present invention has particular utility with respect to microfinishing journals (such as camshafts and crankshafts), cam lobes, and superfinishing and ID tube honing applications, other applications and workpieces are also contemplated. Thus, the scope of the present invention should not be limited to the structures described herein, but only by structures described by the language of the claims and the equivalents of those structures.

We claim:

1. An apparatus for abrading an outer peripheral surface of a workpiece, comprising:

(a) an abrasive tape including an abrasive face and an opposed back face including a first microstructured surface defining a first plane;

(b) support means including a rigid pressure face for supporting said abrasive tape thereon and for urging said abrasive tape against the workpiece, said pressure face having mounted thereon a resilient layer conformable to the pressure face, the resilient layer including a second microstructured surface defining a second plane;

wherein said first microstructured surface comprises a first plurality of tapered elements and said second microstructured surface comprises a second plurality of tapered elements, said tapered elements including sides inclined relative to said planes of said microstructured surfaces and being configured such that when said first plurality of tapered elements is in intermeshing engagement with said second plurality of tapered elements, frictional forces between said sides of said first plurality of tapered elements and said sides of said second plurality of tapered elements maintain said tapered elements in intermeshing engagement so as to prevent relative movement between said abrasive tape and said pressure face in response to shear forces induced during abrading; and (c) means for rotating one of the workpiece and the support means relative to the other of the workpiece and the support means;

whereby said abrasive face abrades material from the outer peripheral surface of the workpiece during relative rotation between the workpiece and said support means.

2. The apparatus of claim 1, wherein said support means comprises a support shoe.

3. The apparatus of claim 1, wherein said pressure face of said support means is concave.

4. The apparatus of claim 1, wherein said pressure face of said support means is convex.

5. The apparatus of claim 1, further comprising:

(d) means for periodically indexing said abrasive tape with respect to said pressure face.

6. The apparatus of claim 1, wherein at least one of said first and second microstructured surfaces comprises a multiplicity of parallel alternating ridges and grooves.

7. The apparatus of claim 1, wherein at least one of said first and second microstructured surfaces comprises a multiplicity of truncated pyramids.

8. An apparatus for abrading an outer peripheral surface of a journal, comprising:

(a) an abrasive tape including an abrasive face and a back face including a first microstructured surface defining a first plane; and (b) at least one support shoe including a rigid pressure face for supporting said abrasive tape thereon and for urging said abrasive tape against the journal, said pressure face having mounted thereon a resilient layer conformable to the pressure face, the resilient layer including a second microstructured surface defining a second plane;

wherein said first microstructured surface comprises a first plurality of tapered elements and said second microstructured surface comprises a second plurality of tapered elements, said tapered elements including sides inclined relative to said planes of said microstructured surfaces and being configured such that when said first plurality of tapered elements is in intermeshing engagement with said second plurality of tapered elements, frictional forces between said sides of said first plurality of tapered elements and said sides of said second plurality of tapered elements maintain said tapered elements in intermeshing engagement so as to prevent relative movement between said abrasive tape and said pressure face in response to shear forces induced during abrading;

whereby said abrasive face abrades material from the peripheral surface when the journal is rotated relative to said at least one support shoe.

9. A method of abrading an outer peripheral surface of a workpiece, comprising the steps of:

(a) providing an abrasive tape having an abrasive face and a back face including a first microstructured surface defining a first plane, wherein said first microstructured surface comprises a first plurality of tapered elements including sides inclined relative to said first plane;

(b) providing a support shoe having a rigid pressure face for supporting the abrasive tape thereon, the pressure face having mounted thereon a resilient layer conformable to the pressure face, the resilient layer including a second microstructured surface defining a second plane, wherein said second microstructured surface comprises a second plurality of tapered elements including sides inclined relative to said second plane;

(c) intermeshing the first and second microstructured surfaces such that frictional forces between said sides of said first plurality of tapered elements and said sides of said second plurality of tapered elements maintain said tapered elements in intermeshing engagement so as to prevent relative movement between said abrasive tape and said pressure face in response to shear forces induced during abrading;

(d) contacting the outer peripheral surface of workpiece with said abrasive tape; and (e) inducing relative rotation between the workpiece and the support shoe to abrade material from the peripheral surface of the workpiece.

10. The method of claim 9, wherein step (e) comprises rotating the workpiece and with respect to the support shoe.

11. The method of claim 9, further including the step of indexing the abrasive tape by:

(i) removing the workpiece from contact with the abrasive tape;

(ii) detaching the abrasive tape from the pressure face by separating the first and second microstructured surfaces from each other;

(iii) advancing the abrasive tape by a predetermined distance; and (iv) contacting the abrasive tape with the workpiece to enable intermeshing engagement between the first and second microstructured surfaces.

12. The method of claim 9, and further including the steps of:

(f) providing a supply of lubricant; and (g) applying lubricant at an interface between the abrasive surface and the outer peripheral surface of the workpiece to facilitate abrading.

* * * * *